US011331775B2

(12) United States Patent
Liao

(10) Patent No.: US 11,331,775 B2
(45) Date of Patent: May 17, 2022

(54) SWITCH STRUCTURE OF ELECTRIC SCREWDRIVER

(71) Applicant: Hsieh Yuan Liao, Taipei (TW)

(72) Inventor: Hsieh Yuan Liao, Taipei (TW)

( * ) Notice: Subject to any disclaimer, the term of this patent is extended or adjusted under 35 U.S.C. 154(b) by 482 days.

(21) Appl. No.: 16/392,637

(22) Filed: Apr. 24, 2019

(65) Prior Publication Data

US 2020/0338698 A1 Oct. 29, 2020

(51) Int. Cl.
*B25B 21/00* (2006.01)
*B25F 5/00* (2006.01)

(52) U.S. Cl.
CPC ..... *B25B 21/00* (2013.01); *B25F 5/001* (2013.01)

(58) Field of Classification Search
None
See application file for complete search history.

(56) References Cited

U.S. PATENT DOCUMENTS 4,878,404 A * 11/1989 Liao ..... B25B 21/00 81/54
5,557,990 A * 9/1996 Shin ..... B25B 21/00 81/429
10,029,354 B2 * 7/2018 Weller ..... B25B 21/00
2004/0089528 A1 * 5/2004 Totsu ..... B25B 21/00 200/293.1

* cited by examiner

*Primary Examiner* — Brian D Keller
(74) *Attorney, Agent, or Firm* — Alexander Chen, Esq.

(57) ABSTRACT

An improved electric screwdriver switch, wherein the switch is installed in a push-down type electric screwdriver, the lower end of the electric screwdriver is provided with a screwdriver head, and its inside is provided with a thimble; the switch includes a structure base with an inner slot and a micro-switch with a touch rod; the inner slot is provided with a L-rod and a spring, and the micro-switch is electrically connected to the motor of the electric screwdriver; when the electric screwdriver presses down the screwdriver head, the inner thimble is linked, and the upper end of the thimble touches the lower end of the L-rod; the touch distance of the upper end of the L-rod and the touch rod on the micro-switch can determine that the motor drives the start/stop of the screwdriver head; the improved structure base is designed as a whole, it features the strong structure and high precision, it is not easy to loose after installation. It can accurately reflect the micro touch switch, and improve the efficiency of the screw lock operation.

4 Claims, 5 Drawing Sheets

SWITCH STRUCTURE OF ELECTRIC SCREWDRIVER

BACKGROUND OF INVENTION

1. Field of the Invention

The present invention relates generally to an improved switch structure of the electric screwdriver, and more particularly to a design as a whole of the improved switch structure base, which can accurately reflect the micro touch switch and enhance the efficiency of screw lock operation.

2. Description of Related Art

The online operation of the push-down type electric screwdriver is used repeatedly and continuously. In the components, it is installed in the push-down type electric screwdriver switch, which controls the operation of the electric screwdriver head; after the push-down type electric screwdriver head is pressed down, it is upwardly touched by the internal thimble, so that the thimble triggers the switch to start, and a series of gear sets is linked through the motor of the electric screwdriver, and the clutch set will drive the screwdriver head to obtain the preset torque output; However, with the requirements of industrial upgrading and precision screw lock operation, the switch parts assembled on the market are generally repeated in the operation of the screw lock, which is easy to loose and has a short life and is not accurate, therefore, the switch combined with the push-down type electric screwdriver should be specially designed to accurately reflect the pressing/releasing state of the screwdriver head, so that it can improve the efficiency of the screw lock operation and prolong the service life of the switch.

Therefore, the inventor of this invention considers that in addition to being able to continuously exist in the market, the more excellent tool product should be continuously developed, especially for the precision of the screw lock, the more attention should be paid, so this invention is designed to be more practical.

SUMMARY OF THE INVENTION

This invention mainly aims to provide an improved structure of the electric screwdriver switch. The main improved structure base is designed as a whole. Compared with the general switch combination, it features the strong structure and high precision, and it is not easy to loose after installation. It can accurately reflect the micro touch switch, improve the efficiency of the screw lock operation, and further prolong the service life of the switch.

In order to achieve the above object, the technical means adopted in this invention is to design an improved electric screwdriver switch structure, the switch is installed in a push-down type electric screwdriver, the lower end of the electric screwdriver is equipped with a screwdriver head, and its inside is equipped with a thimble; the switch includes a structure base with an inner slot and a micro-switch with a touch rod, wherein the inner groove is provided with a spring, an L-rod and an inserted plug pin, and the micro-switch is electrically connected to the motor of the electric screwdriver, the L-rod and the spring are snapped into the inner slot, the spring is snapped into the upper end of the L-rod, and the plug pin is pressed against the inner corner of the upper end of the L-rod, the position of which makes the spring have pre-stressing, and limit the movement range of the L-rod; when the electric screwdriver presses down the screwdriver head, the inner thimble is linked, and the upper end of the thimble touches the lower end of the L-rod and push it into the inner slot, and the upper end part of the L-rod protruding outside the inner slot is linked, so as to touch or not touch the touch rod on the micro-switch, corresponding to the motor to be energized/not energized, the screwdriver head is driven for the screw lock operation.

The structure base is a rectangular type, and two fixing lugs are extended at both sides of the structure base, and the lock is attached to the electric screwdriver.

The structure base is provided with a lock hole, and the micro-switch is locked in the lock hole.

The micro-switch is provided with positive electricity, negative electricity and grounding terminal electrically connected to the motor of the electric screwdriver.

The lower end of the L-rod is provided with an apical plate for touching the upper end of the thimble.

DETAILED DESCRIPTION OF THE INVENTION

Figure 1:
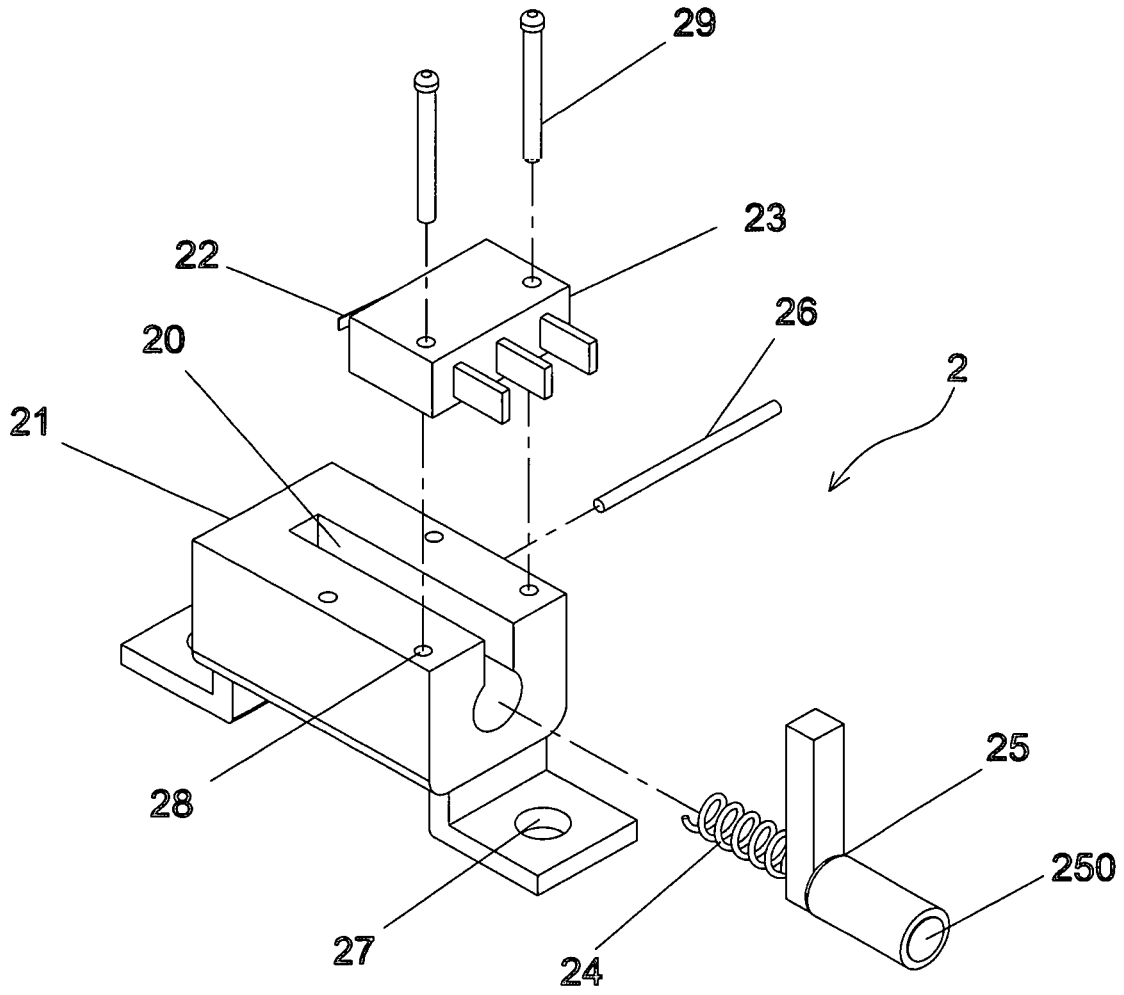
FIG. 1 is a schematic diagram for structural decomposition of the electric screwdriver switch of the present invention.
Figure 2A:
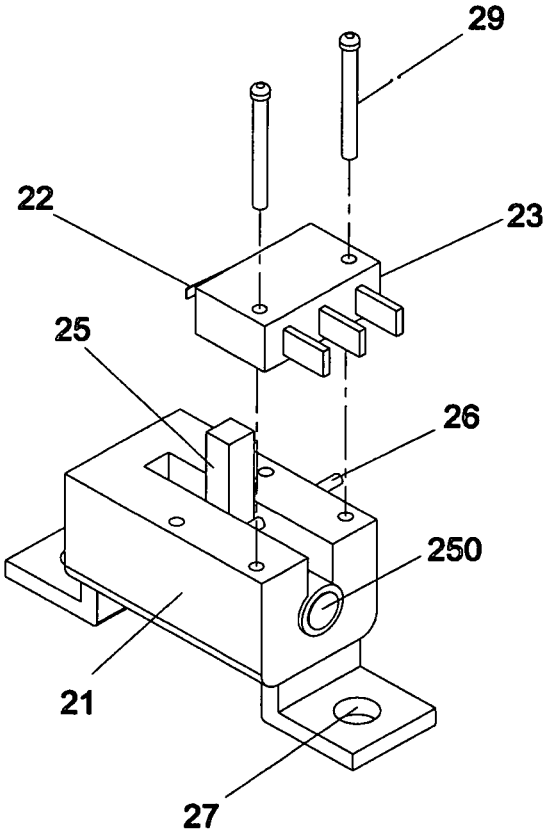
FIG. 2(A) is a schematic diagram for of the combination (A) and FIG. 2(B) is a schematic diagram for the combination (B) of the electric screwdriver switch structure part of the present invention.
Figure 2B:
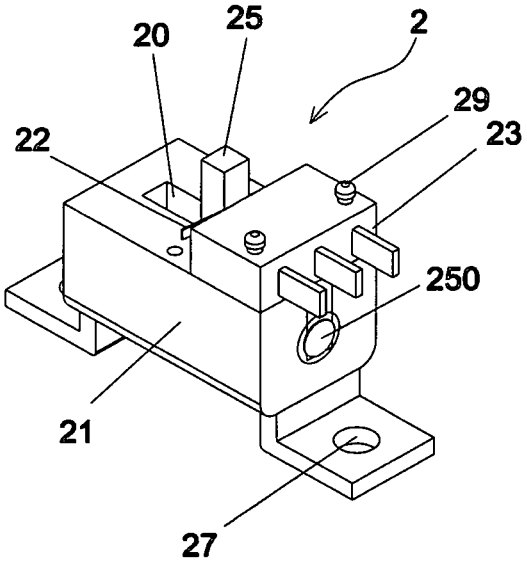
Figure 3:
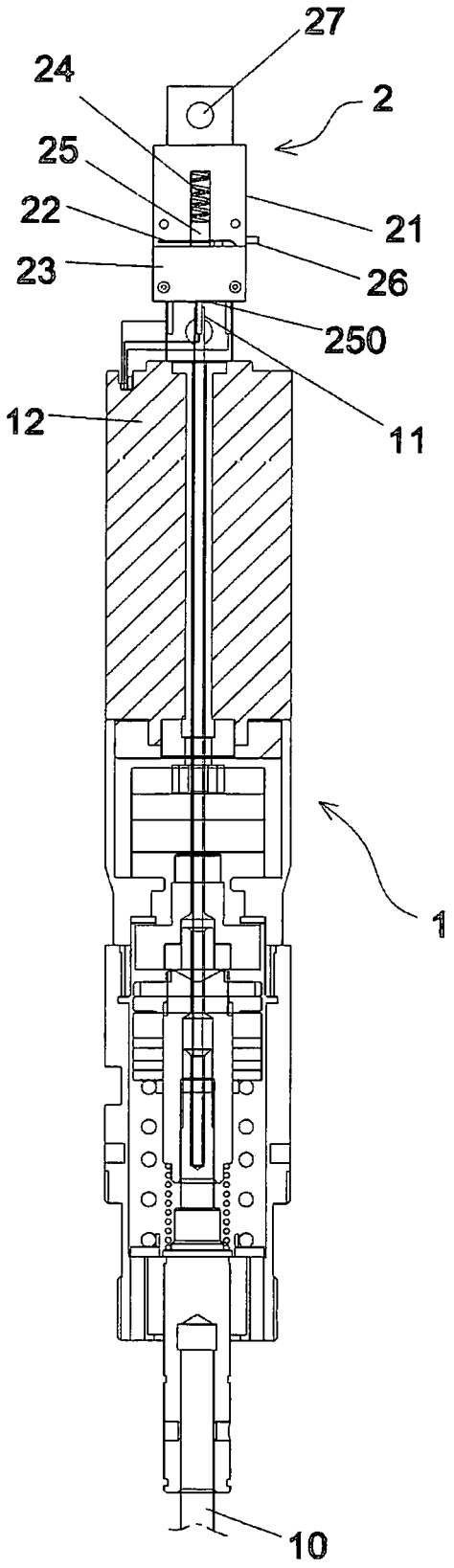
FIG. 3 is a schematic diagram for combination of electric screwdriver switch structure disposed above electric screwdriver of the present invention.

Referring to FIG. 1~FIG. 3, which are the decomposition, partial combination and combination diagrams of the switch structure with a push-down type electric screwdriver.

The electric screwdriver switch designed in the present invention is installed in a push-down type electric screwdriver 1. The lower end of the electric screwdriver is provided with a screwdriver head 10, and its inside is provided with a thimble 11. The electric screwdriver 1 includes: a motor 12, a gear set, a clutch set, a torque group and a connecting shaft; the switch 2 includes a structure base 21 with inner slot 20 and a micro-switch 23 with touch rod 22; the inner slot 20 is provided with a spring 24, a L-rod 25 and an inserted plug pin 26, the micro-switch 23 is electrically connected to the motor 12 of the electric screwdriver 1, the micro-switch 23 is provided with positive electricity, negative electricity and grounding terminal electrically connected to the motor 12 of the electric screwdriver 1; the L-rod 25 and the spring 24 are snapped into the inner slot 20, and the spring 24 is snapped into the upper end of the L-rod 25. The plug pin 26 is pressed against the inner corner of the upper end of the L-rod 25, and its position makes the spring 24 have a pre-stressing and limit the movement range of the L-rod 25; the lower end of the L-rod 25 is provided with an apical plate 250 for contacting the upper end of the thimble 11.

The structure of the electric screwdriver switch of the present invention is improved in that the structure base 21 is designed as a whole, two fixing lugs 27 are extended on both sides of the structure base 21, and the lock is attached to the electric screwdriver 1; the structure base 21 is provided with a lock hole 28, the micro-switch 23 is locked in the lock hole 28 by the screw 29, compared with the general switch or the combination of parts, it features the strong structure and high precision, and it is not easy to loose after installation, and it can accurately reflect the micro touch switch, and improve the efficiency of the screw lock operation and further prolong the service life of the switch.

Figure 4:
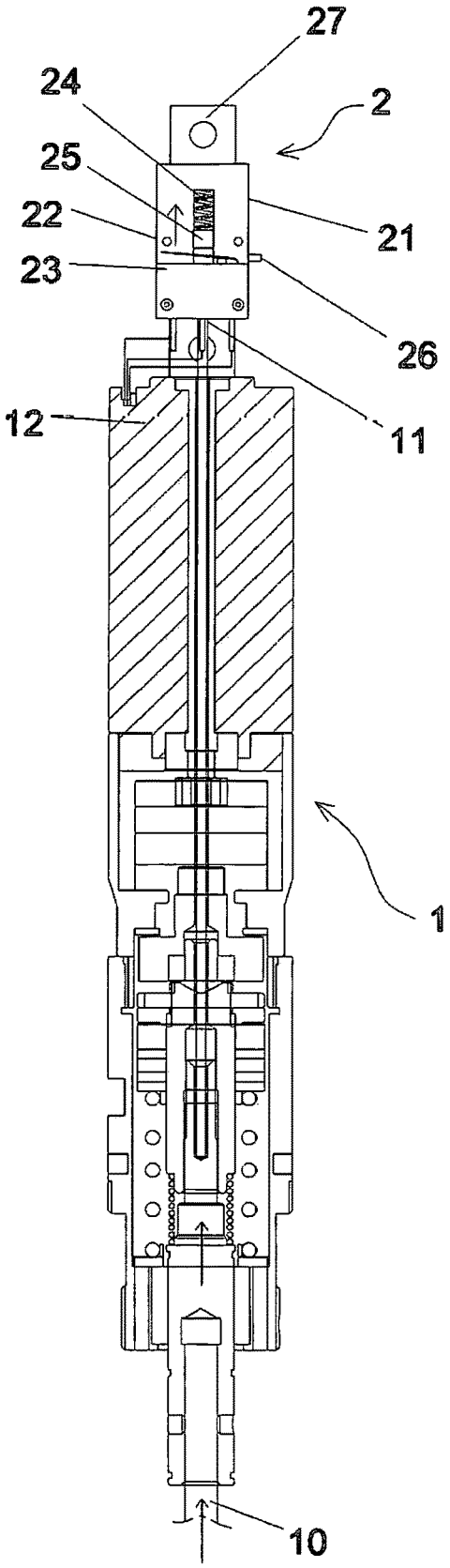
FIG. 4 is a schematic diagram for the thimble action relationship between touch rod and electric screwdriver on L-rod and micro-switch of the present invention.

Referring to FIG. 3 and FIG. 4, when the push-down type electric screwdriver presses down the screw-driver head 10, the improved switch installed in the push-down type electric screwdriver will pushes upward the inside thimble 11, and the upper end of the thimble 11 will touch the lower end of to the lower end of the L-ROD 25 and push it into the inside of the slot 20, to link the upper end part of the L-ROD 25 protruded outside of the inner slot 20, so as to touch or not touch the touch rod 22 on the micro-switch 23, corresponding to the motor 12 being energized/not energized, the screwdriver head 10 is driven for the screw lock operation.

Figure 5A:
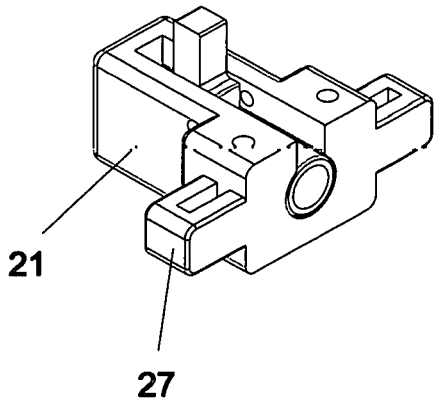
FIG. 5(A) and FIG. 5(B) are the schematic diagrams for the fixing lug disposed at different position of the structure base of the present invention.
Figure 5B:
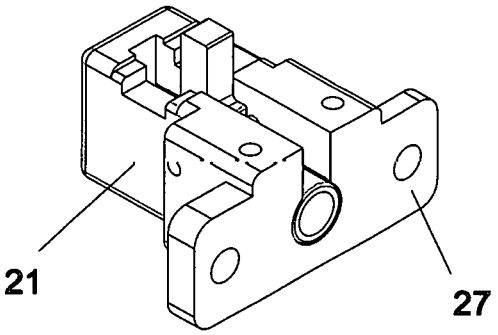

Referring to FIG. 5(A) and FIG. 5(B), which are the schematic diagrams for the fixing lug disposed at different position of the structure base of the present invention. The two fixing lugs 27 of the present invention extended on the structure base 21 can be disposed at the suitable location of the structure base and fixed in the inside of the electric screwdriver.

The foregoing is a specific embodiment of the present invention and the technical means applied herein, and many variations and modifications can be derived therefrom based on the disclosure or teachings herein, if the equivalent changes made according to the conception of this invention have not yet exceeded the essence of the spirit covered by the instructions and schemata, they should be considered as being in the technical scope of this invention.

The invention claimed is:

1. An improved electric screwdriver switch, wherein the switch is installed in a push-down type electric screwdriver, a lower end of the electric screwdriver is provided with a screwdriver head, and an inside of the screwdriver head is provided with a thimble; the switch includes a structure base with an inner slot and a micro-switch with a touch rod; the inner slot is provided with a spring, a L-rod and an inserted plug pin, and the micro-switch is electrically connected to a motor of the electric screwdriver, the L-rod and the spring are disposed in an upper end of the inner slot, the spring is disposed in an upper end of the L-rod, and the plug pin is pressed against an inner corner of the upper end of the L-rod, a position of the plug pin causes the spring to be prestressed, and limit a movement range of the L-rod; when the electric screwdriver presses down the screwdriver head, the thimble is actuated, and an upper end of the thimble touches a lower end of the L-rod and pushes the lower end of the L-rod into the inner slot, and the upper end of the L-rod that protrudes outside the inner slot is actuated, so as to selectively touch the touch rod on the micro-switch, corresponding to the motor to be selectively energized, the screwdriver head is driven for a screw lock operation.

2. The improved electric screwdriver switch as claimed in claim 1, wherein the structure base is rectangular, and two fixing lugs are extended at two sides of the structure base, and the structure base is attached to the electric screwdriver via the fixing lugs.

3. The improved electric screwdriver switch as claimed in claim 1, wherein the structure base is provided with a lock hole, and the micro-switch is locked in the lock hole.

4. The improved electric screwdriver switch as claimed in claim 1, wherein the micro-switch is provided with positive electricity, negative electricity and grounding terminal electrically connected to the motor of the electric screwdriver.

* * * * *